US006305285B1

(12) United States Patent
Steven

(10) Patent No.: US 6,305,285 B1
(45) Date of Patent: Oct. 23, 2001

(54) SHEET SETTLING SYSTEM

(75) Inventor: Andrew Steven, Nr. Ryton (GB)

(73) Assignee: Crabtree of Gateshead Ltd., Tyne & Wear (GB)

( * ) Notice: Subject to any disclaimer, the term of this patent is extended or adjusted under 35 U.S.C. 154(b) by 0 days.

(21) Appl. No.: 09/212,796

(22) Filed: Dec. 16, 1998

Related U.S. Application Data

(63) Continuation-in-part of application No. 08/719,656, filed on Sep. 25, 1996, now abandoned.

(51) Int. Cl.[7] ..... B41F 1/28; B65H 29/68

(52) U.S. Cl. ..... 101/474; 271/13; 271/181; 271/182; 271/226; 271/276

(58) Field of Search ..... 101/474; 271/181, 271/182, 183, 231, 226, 276

(56) References Cited

U.S. PATENT DOCUMENTS

| | | | | |
|---|---|---|---|---|
| Re. 29,206 | * | 5/1977 | Jaffa | 101/407 |
| 3,791,269 | | 2/1974 | Sawada . | |
| 3,835,776 | * | 9/1974 | Wiedman | 101/136 |
| 3,958,508 | * | 5/1976 | Sakurai | 101/407 BP |
| 3,975,057 | | 8/1976 | Hurd . | |
| 4,221,377 | | 9/1980 | Bodewein et al. . | |
| 4,307,661 | | 12/1981 | Wilkins et al. . | |
| 4,436,302 | | 3/1984 | Frye et al. . | |
| 4,648,589 | | 3/1987 | Emrich et al. . | |
| 5,201,517 | * | 4/1993 | Stemmie | 271/291 |
| 5,323,701 | * | 6/1994 | Sommer | 101/126 |
| 5,423,255 | * | 6/1995 | Maass | 101/232 |
| 5,460,361 | | 10/1995 | Mokler . | |
| 5,569,016 | | 10/1996 | Mokler . | |
| 5,875,028 | * | 2/1999 | Laskew et al. | 356/244 |
| 5,988,065 | * | 11/1999 | Schroder et al. | 101/389.1 |
| 6,100,911 | * | 8/1998 | Kerr | 347/224 |

FOREIGN PATENT DOCUMENTS

| | | | |
|---|---|---|---|
| 564322 | * | 9/1944 | (GB) . |
| 2 016 423 A | | 9/1979 | (GB) . |

* cited by examiner

*Primary Examiner*—Joseph E. Valenza
*Assistant Examiner*—Michael E. Butler
(74) *Attorney, Agent, or Firm*—Adams, Schwartz & Evans, P.A.

(57) ABSTRACT

In a high speed sheet printing or coating machine there is a tendency for the sheets to move about as they are being fed to the datum stops, so that precise registration is not achieved. This is remedied by exerting a damping force which pulls each sheet continuously towards a fixed support surface 12 before and during registration and during printing or coating. The damping force comprises vacuum and/or magnetic forces which settle each sheet rapidly on the fixed support surface as it is fed into contact with the datum stops. The vacuum force is provided by drawing air through an array of holes 26 in the fixed support surface into an underlying chamber 24 evacuated through a pipe 28 by a vacuum pump, and is adjustable either by controlling the flow rate through the pump or by controllably venting the chamber or pipe to atmosphere. The magnetic force is provided by a row of permanent or electro-magnets 22 in the fixed support surface, and can be adjusted by varying their position perpendicular to that surface. Alternatively, in the case of electro-magnets, the magnetic force is adjustable by varying their supply of electrical power.

10 Claims, 1 Drawing Sheet

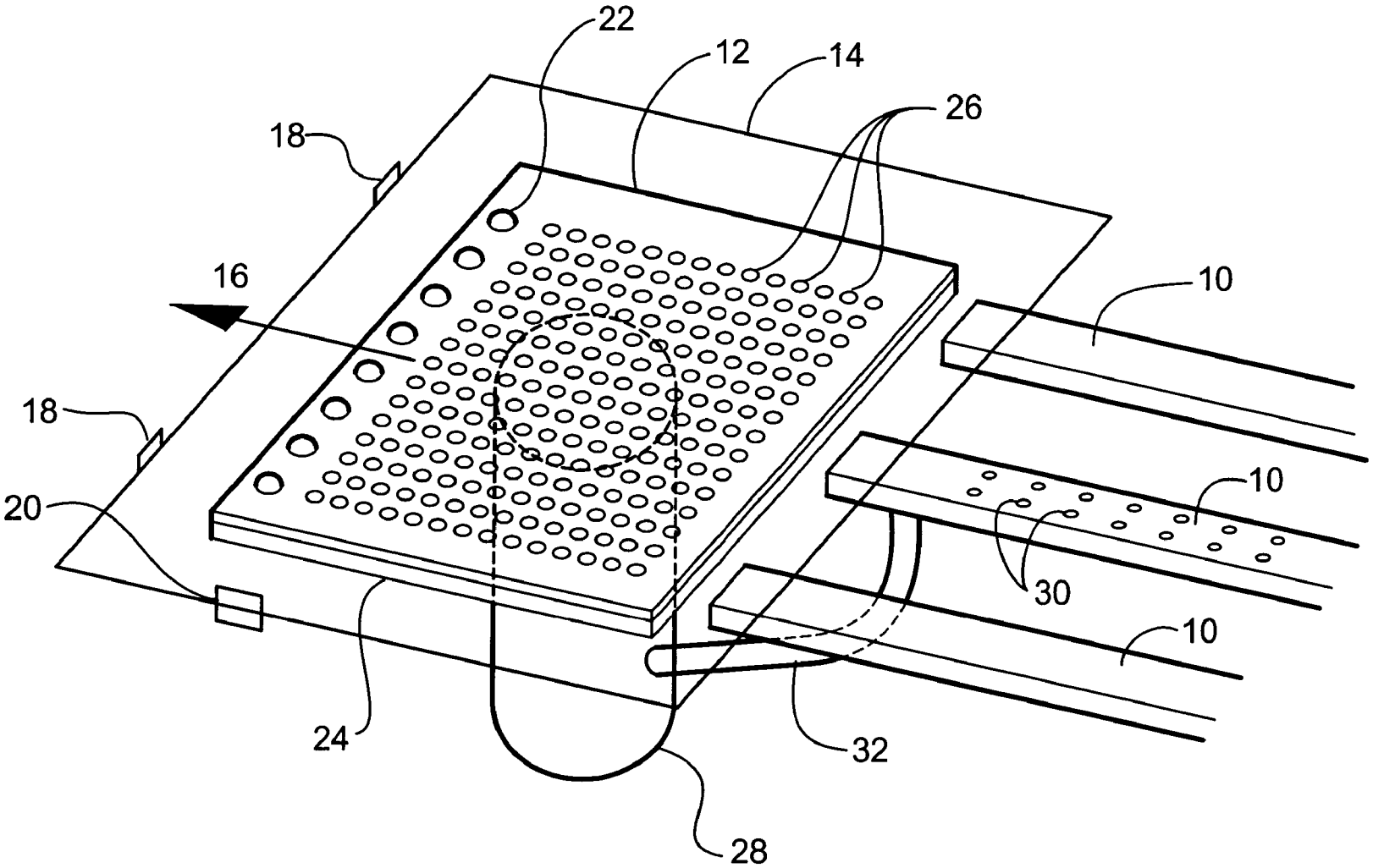
10
10
10
30
26
14
12
22
32
28
18
16
18
20
24

SHEET SETTLING SYSTEM

This application is a continuation-in-part patent application, according to 37 C.F.R. §1.53(b), of U.S. patent application Ser. No. 08/719,656 filed on Sep. 25, 1996.

TECHNICAL FIELD AND BACKGROUND OF THE INVENTION

This invention relates to a sheet settling system, and more particularly to a method of rapidly settling a sheet on a support surface of a sheet printing or coating machine, and to a machine employing the method, The system is applicable to printing and coating machines for sheets of metal, plastics material, paper and card.

Known sheet printing and coating machines generally include two cylinders geared together so as to contra-rotate at the same constant peripheral speed in rolling contact with each other, between which the sheets are passed successively. One of the cylinders transfers an ink impression or a coating such as varnish onto each sheet. In order accurately to register, that is to say locate in position, each sheet relative to the other of the cylinders, said other cylinder carries one or more, usually two, axially-spaced datum stops or so-called front lays for the front edge of the sheet. At least one datum stop is also provided for one side of the sheet. Each sheet is fed towards the front lays on a flat infeed surface by means such as pushers carried by endless chains or the like. When the front edge of the sheet is accurately registered against the front lays, it is gripped by a plurality of cyclically-operated grippers carried by said other cylinder and the sheet is drawn through the nip of the cylinders where it is printed or coated. As the front edge of the sheet emerges from the nip it is released by the grippers and the sheet is moved onwards for further treatment or for stacking. Because these machines operate at high speeds, there is a tendency for the sheets to move or bounce about somewhat as they are being fed towards and into contact with the datum stops, as a result of which registration is not achieved with precise and consistent accuracy.

U.S. Pat. No. 4,648,589 of Enrich et al discloses a printing press in which each sheet is supplied to a feed table where a vacuum force temporarily exerted by pivotable suction arms adjacent to the feed table retards forward movement of the sheet and is then cut off by a rotary valve (so-called suction disc), the sheet is aligned against pivotable front lays, a moveable side lay aligns the sheet against an abutment, the vacuum force is temporarily re-established by the rotary valve, and the suction arms are moved forward, so as again to press the sheet against the front lays. A first cam for pivoting the suction arms, a second cam for moving the side lay, and the rotary valve for intermittently establishing the vacuum force are all driven by, a single shaft. The front lays are pivoted by a cam which must of necessity be driven in appropriate timed relation to said shaft. This suction-assisted alignment system requires a mechanical arrangement of parts which is relatively complex.

SUMMARY OF THE INVENTION

The object of the present invention is to obviate or reduce the aforesaid tendency by providing a very simple system for rapidly settling a sheet on a support surface of a sheet printing or coating machine.

According to one aspect of the invention, a method of rapidly settling a sheet on a fixed support surface of a sheet printing or coating machine with at least the front edge of the sheet in accurate registration with datum stops, comprises exerting a damping force which pulls the sheet continuously towards the fixed support surface before and during registration and during printing or coating.

The method may comprise exerting the force by vacuum means.

The method preferably comprises adjusting the vacuum force.

The method alternatively comprises exerting the force by magnet means.

The method preferably comprises adjusting the magnetic force.

The method may comprise exerting the force by both vacuum and magnet means.

According to another aspect of the invention, a sheet printing or coating machine has means for rapidly settling a sheet on a fixed support surface thereof with at least the front edge of the sheet in accurate registration with datum stops, said means exerting a dampingforce which pulls the sheet continuously towards the fixed support surface before and during registration and during printing or coating.

Said means may be vacuum means.

The vacuum force is preferably adjustable.

Preferably, the vacuum force is provided by a vacuum chamber communicating with the fixed support surface and evacuated by a vacuum pump, and is adjustable by controlling the evacuation flow rate of said pump.

Alternatively, the vacuum force is provided by a vacuum chamber communicating with the fixed support surface and evacuated by a vacuum pump, and is adjustable by controlling the opening of at least one orifice in the vacuum means which opens to atmosphere.

Preferably, also, the vacuum force is additionally exerted on sheets moving along a fixed infeed surface towards the fixed support surface.

In a machine for printing on or coating ferrous sheets, said means are alternatively magnet means.

The magnetic force is preferably adjustable.

Preferably, the magnetic force is adjustable by varying the position of the magnet means in a direction perpendicular to the fixed support surface.

Alternatively, the magnetic force is electro-magnetic and is adjustable by varying the supply of electrical power to the magnet means.

A sheet printing or coating machine may have both vacuum and magnet means. This enables it to settle sheets of any material with maximum efficacy; the vacuum system sufficing to damp lighter weight non-ferrous sheets whilst being supplemented by the magnet system to damp heavier ferrous sheets.

DESCRIPTION OF THE PREFERRED EMBODIMENTS AND BEST MODE

One preferred embodiment of the invention will now be described, by way of example, with reference to the accompanying drawing which is a diagrammatic perspective view of a sheet (drawn transparent for clarity) in registration position on a fixed support surface of a sheet printing or coating machine.

Referring now to the drawing, a sheet printing or coating machine, for example a machine for printing on metal sheets substantially as disclosed in our European Patent (U.K.) No. 0412720 to which reference may be made, includes a horizontal flat fixed infeed surface constituted by a plurality of say three as shown, parallel rails 10 which terminate in a rectangular fixed support surface 12. The surface 12 is disposed close to the entry side of the nip between blanket and impression cylinders (not shown) which are geared together so as to contra-rotate at the same constant peripheral speed and make rolling contact with each other in well-known manner, and said surface is approximately tangential to said cylinders The sheet 14 about to be printed is travelling in the direction of the arrow 16, being fed by a known arrangement (not shown) of pusher means carried by endless chains at approximately the same linear speed as the peripheral speed of said cylinders.

The lower, impression cylinder carries two axially-spaced non-retractable datum stops or so-called front lays 18 which act to register the front edge of the travelling sheet 14 relative to the rotating impression cylinder, and also carries two cyclically-operated grippers (not shown) which are associated with the datum stops 18. A datum stop 20 is also provided for one side of the sheet 14, A row of magnets 22 is provided near that edge of the support surface 12 adjacent to the nip. Said magnets can be either permanent magnets or electro-magnets, and the magnetic force can be adjusted by varying their position in a direction perpendicular to said surface. Alternatively, in the case of electromagnets, the magnetic force is adjustable by varying the supply of electrical power thereto. Underlying the support surface 12 is a vacuum chamber 24 which communicates with said surface through an array of holes 26. The chamber 24 is evacuated by a conventional vacuum pump (not shown) by way of a pipe 28. The vacuum force is exerted continuously, and is adjustable either by controlling the evacuation flow rate of said pump, or by controlling the opening of a number of orifices (not shown) in the vacuum chamber 24 and/or the pipe 28 which open to atmosphere. The middle rail 10 is hollow with closed ends and also has an array of holes 30 in its upper surface. The interior of the middle rail 10 is connected to the pipe 28 by a branch-pipe 32.

In operation, a ferrous sheet 14 is pulled close to the rails 10 by the continuous suction effect of the vacuum in the middle one of said rails as it travels along them. It is then rapidly settled on the support surface 12 by the combined attraction of the magnets 22 and suction effect of the vacuum in the chamber 24 which pulls the sheet continuously towards the fixed support surface before and during registration and during printing or coating. Accurate registration of the sheet 14 with the datum stops 18 and 20 is thereby facilitated, after which its front edge is gripped by the grippers and it is drawn through the nip of the cylinders where it is printed or coated. Finally, as the front ledge of the sheet 14 emerges from the nip it is released by the grippers and moved onwards for stacking. For non-ferrous sheets 14, the magnets 22 are ineffective, and if electromagnetic can be switched off.

In one modification, further magnets are provided in other areas of the support surface 12. In another modification, the branch-pipe 32 is dispensed with and the hollow middle rail 10 communicates at one end directly with the vacuum chamber 24 and is closed at the other end.

It will be appreciated theft the vacuum system can be used alone for sheets of any material, and that the magnet system can be used alone for sheets of exclusively ferrous material.

What is claimed is:

1. A method of rapidly settling a sheet on a fixed support surface of a sheet printing or coating machine with at least the front edge of the sheet in accurate registration with datum stops, comprising pulling the sheet continuously towards the fixed support surface before and during registration and during printing or coating by making available both vacuum and magnetic forces and employing at least one of said forces.

2. A method according to claim 1, wherein at least one of said forces is adjustable.

3. A sheet printing or coating machine having means for rapidly settling a sheet on a fixed support surface thereof with at least the front edge of the sheet in accurate registration with datum stops, said means comprising both vacuum means and magnet means which are operable either together or individually for pulling the sheet continuously towards the fixed support surface before and during registration and during printing or coating.

4. A machine according to claim 3, wherein the vacuum means provide an adjustable vacuum force.

5. A machine according to claim 4, wherein the vacuum force is provided by a vacuum chamber communicating with the fixed support surface and evacuated by a vacuum pump, and is adjustable by controlling the evacuation flow rate of said pump.

6. A machine according to claim 4, wherein the vacuum force is provided by a vacuum chamber communicating with the fixed support surface and evacuated by a vacuum pump, and is adjustable by controlling the opening of at least one orifice in the vacuum means which opens to atmosphere.

7. A machine according to any one of claims 4 to 6, wherein the vacuum force is additionally exerted on sheets moving along a fixed infeed surface towards the fixed support surface.

8. A machine according to claim 3, wherein the magnetic means provide an adjustable magnetic force.

9. A machine according to claim 3, wherein the magnetic force is adjustable by varying the position of the magnet means in a direction perpendicular to the fixed support surface.

10. A machine according to claim 8, wherein the magnetic force is electro-magnetic and is adjustable by varying the supply of electrical power to the magnet means.

* * * * *